US005213514A

United States Patent [19]

Arai

[11] Patent Number: 5,213,514

[45] Date of Patent: May 25, 1993

[54] MULTIPOLE ELECTRICAL CONNECTOR

[75] Inventor: Tatsuya Arai, Tokyo, Japan

[73] Assignee: Hirose Electric Co., Ltd., Tokyo, Japan

[21] Appl. No.: 755,846

[22] Filed: Sep. 6, 1991

[30] Foreign Application Priority Data

Sep. 17, 1990 [JP] Japan ..... 2-96514[U]

[51] Int. Cl.[5] ..... H01R 9/09

[52] U.S. Cl. ..... 439/79; 439/82

[58] Field of Search ..... 439/79-83, 439/660

[56] References Cited

U.S. PATENT DOCUMENTS 4,797,114 1/1989 Lau ..... 439/79

4,995,819 2/1991 Ohl ..... 439/82

5,085,601 2/1992 Buchter et al. ..... 439/79

*Primary Examiner*—Paula A. Bradley

*Attorney, Agent, or Firm*—Kanesaka & Takeuchi

[57] ABSTRACT

An electrical contact for a multipole electrical connector, includes a contact section (56*a*, 57*a*) having a C-shaped portion with a contact point at a peak thereof; an intermediate section (56*d*, 57*d*) extending from an end of the contact section; a press-fit section (56*b*, 57*b*) extending from an end of the intermediate section; and the intermediate section having a thickness which is gradually increased toward the press-fit section, thereby bending uniformly the intermediate section when a lateral force is applied. The intermediate section has a C-shaped base portion to further reduce the spring constant. The length of an intermediate section is made different from those of adjacent intermediate sections so as to offset the contact points alternately, thereby minimizing the plugging force.

1 Claim, 12 Drawing Sheets

MULTIPOLE ELECTRICAL CONNECTOR

BACKGROUND OF THE INVENTION

1. Field of the Invention

The present invention relates generally to two-piece electrical connectors for connecting two circuit boards and, more particularly, to a two-piece electrical connector having a large number of terminals.

2. Description of the Prior Art

The mounting density of circuit boards increases as the integration density of semiconductor devices increases. For example, the number of terminals of a conventional LSI package has been about 100, but now it is 400 or more. As a result, the number of terminals to be connected across circuit boards is increased to 200 or more. However, there are no super multipole connecters which have three or more rows of terminals because of lack of the manufacturing technology. In addition, most of the conventional multipole connectors are of the insulation displacement type. There is a great demand for super multipole connectors which require small plugging forces, thereby enhancing its operability.

SUMMARY OF THE INVENTION

Accordingly, it is an object of the invention to provide a super multipole electrical connector to satisfy such a demand as described above.

According to the invention there is provided a super multipole electrical connector which includes a substantially rectangular housing having a plurality of terminal receiving channels and first terminal apertures each communicating with corresponding terminal receiving channels; a flat locator secured to the housing at substantially right angles and having a plurality of second terminal apertures each having an axis substantially perpendicular to that of the first terminal aperture; a plurality of signal terminals having a contact section projecting along the terminal receiving channel, a press-fit section received in the first terminal aperture, and a leg section received in the second terminal aperture of the flat locator; the contact section having a C-shaped portion with a contact point at a peak thereof; a thickness of an intermediate section between the contact section and the press-fit section being gradually increased toward the press-fit section; and a base portion of the intermediate section having a C-shaped portion so that the contact points of adjacent signal terminals are offset with each other.

Since the intermediate section between the contact section and the press fit section is gradually increased in thickness toward the press fit section and since the base portion of the intermediate section is formed in a C-shape so that not only the height h but also the spring constant are minimized. In addition, the heights of signal contacts of adjacent signal terminals are offset with each other so that the plugging force is reduced, thereby enhancing the operability of a super multipole electrical connector.

The above and other objects, features, and advantages of the invention will be more apparent from the following description when taken in conjunction with the accompanying drawings.

DESCRIPTION OF THE PREFERRED EMBODIMENT

Figure 1:
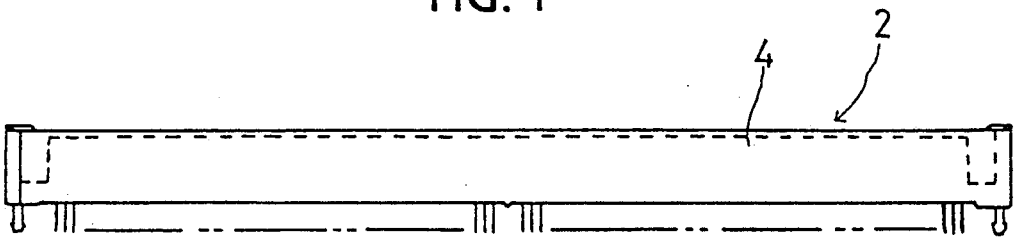
FIG. 1 is a top plan view of a male connector according to an embodiment of the invention.
Figure 2:
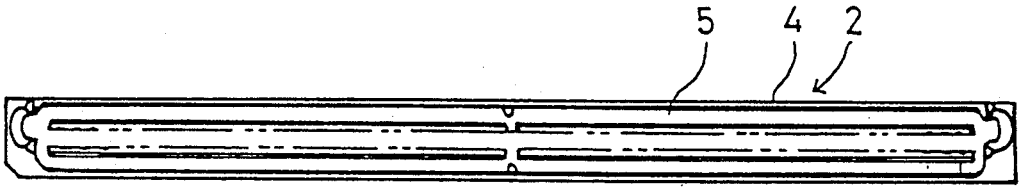
FIG. 2 is a front view of the male connector.
Figure 3:
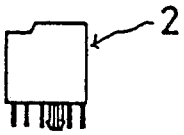
FIG. 3 is a side view of the male connector.
Figure 4:
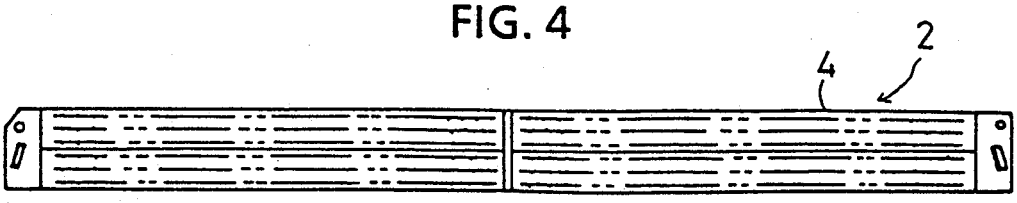
FIG. 4 is a rear view of the male connector.
Figure 5:
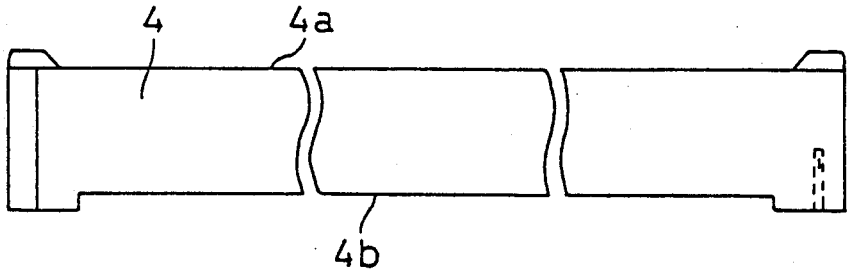
FIG. 5 is a top plan view of a housing of the male connector.
Figure 6:
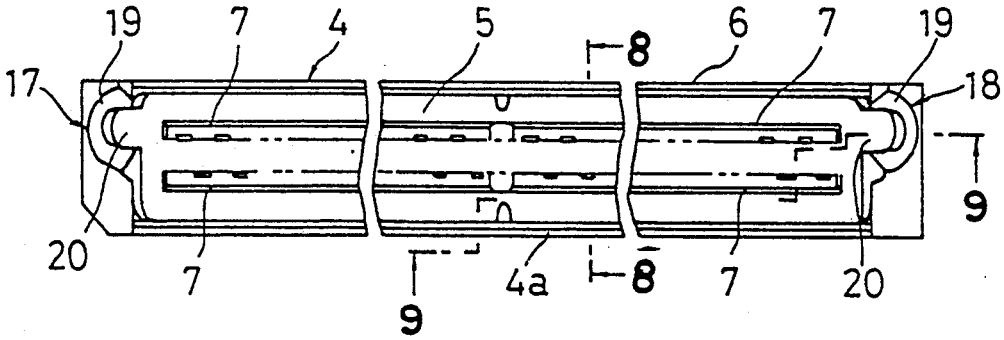
FIG. 6 is a front view of the housing.
Figure 7:
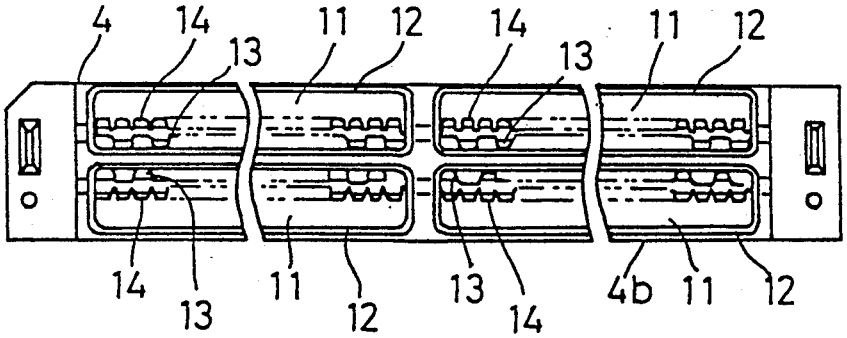
FIG. 7 is a rear view of the housing.
Figure 8:
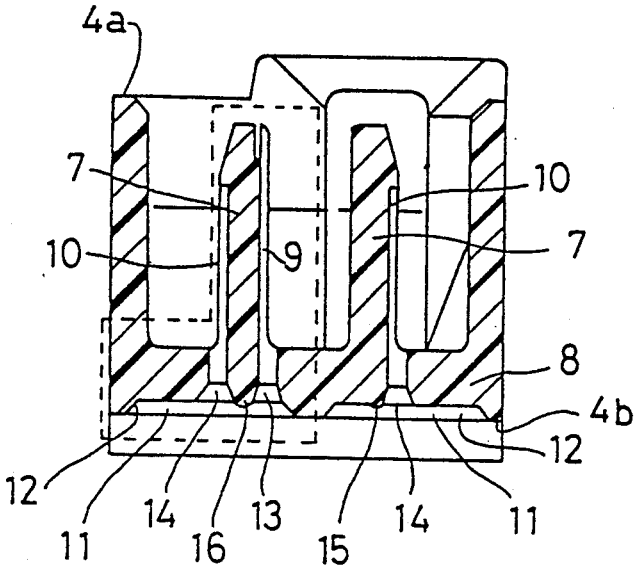
FIG. 8 is a sectional view taken along line 8—8 of FIG. 6.
Figure 9:
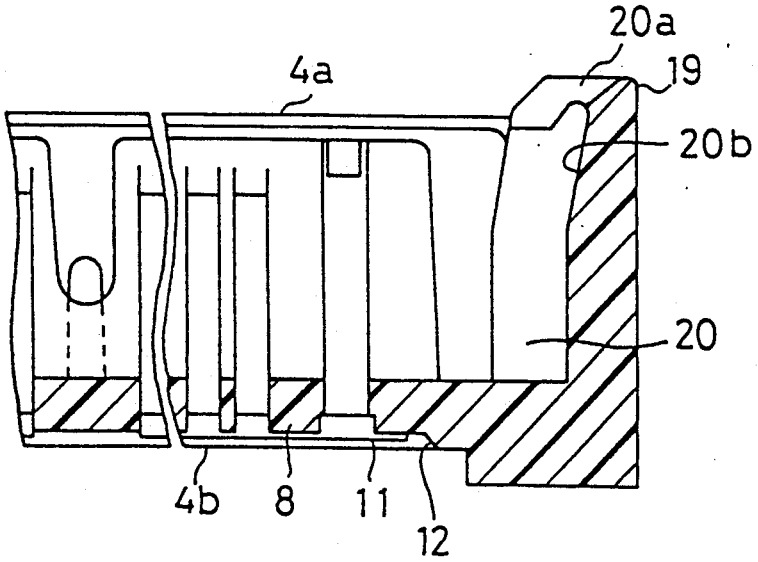
FIG. 9 is a sectional view taken along line 9—9 of FIG. 6.
Figure 10:
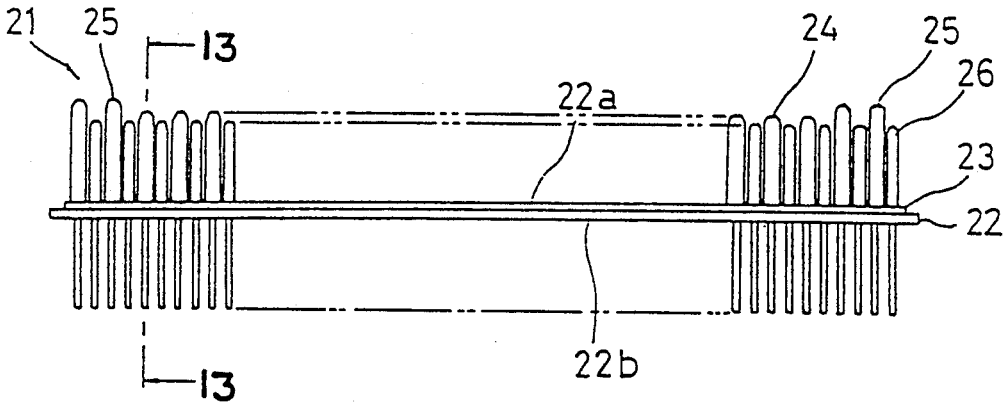
FIG. 10 is a top plan view of a terminal unit according to an embodiment of the invention.
Figure 11:
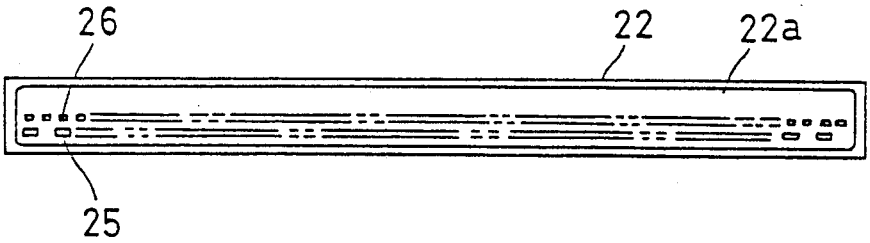
FIG. 11 is a front view of the terminal unit.
Figure 12:
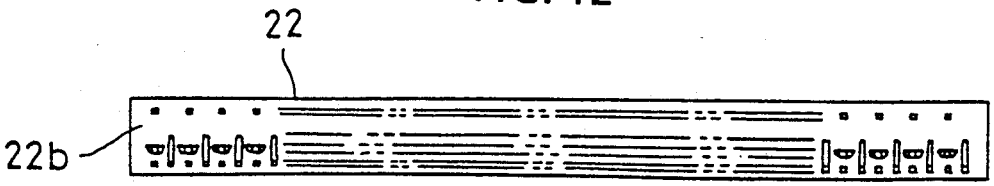
FIG. 12 is a rear view of the terminal unit.
Figure 21:
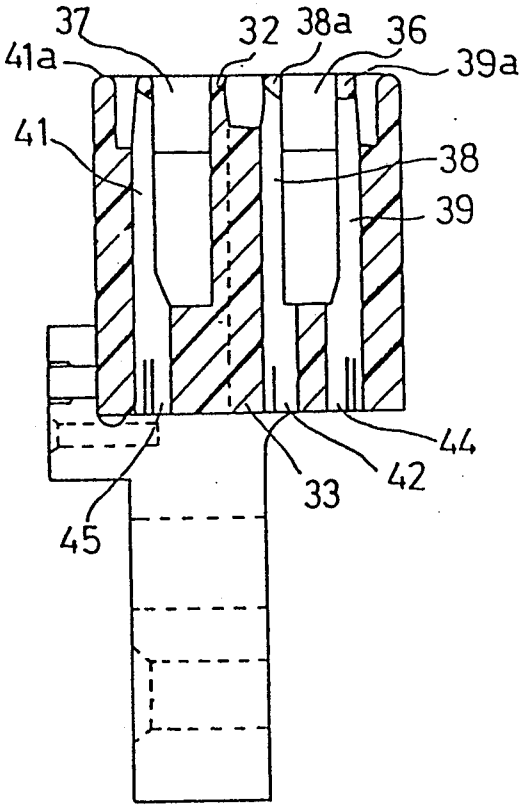
FIG. 21 is a sectional view taken along line 21—21 of FIG. 19.
Figure 20:
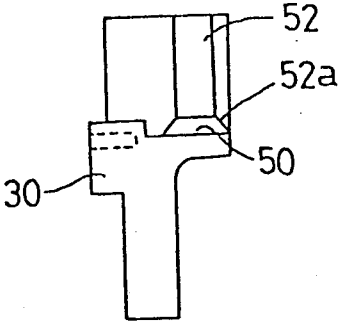
FIG. 20 is a side view of the housing.
Figure 13:
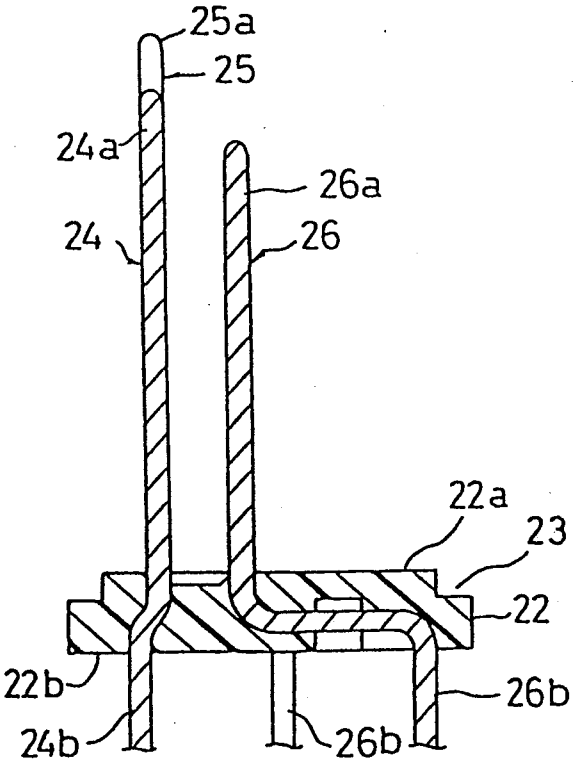
FIG. 13 is a sectional view taken along line 13—13 of FIG. 10.

In FIGS. 1–4, a male connector 2 of the straight DIP type includes a rectangular housing 4 made from a synthetic resin.

In FIGS. 5–9, the housing 4 has a rectangular fitting cavity 5 on its front side **4*a* surrounded by a side wall 6. Two pairs of insulation plates 7 extend forwardly from the bottom 8 of the fitting cavity 5. A number of power terminal receiving channels 9 are formed on the inside of the insulation plates 7 at a predetermined pitch while a number of signal terminal receiving channels 10 are formed on the outside of the insulation plates 7** at a half of the predetermined pitch.

Two pairs of rectangular terminal plate receiving recesses 11 are formed on the rear side **4*b* of the housing 4, thus dividing the rear side 4*b* into four areas. Each receiving recess 11 has an outwardly sloped wall 12. Terminal apertures 13 and 14 are formed on the receiving recess 11 so as to communicate with the receiving channels 9 and 10, respectively. Ridges 15 and 16 are formed on the receiving recess 11 beneath the insulation plates 7**.

A pair of foolproof sections 17 and 18 are formed on opposite sides of the front face **4*a* for preventing insertion errors. The foolproof section 17 or 18 has a guiding portion 19 raised from the front face 4a such that it has a foolproof recess 20 on the extension line of the upper insulation plates 7. The foolproof recess 20 has an expanded arcing portion 20a and a tapered side wall 20b**.

In FIGS. 10–13, a terminal unit 21 includes a rectangular terminal plate 22 which is fitted in the terminal plate receiving recess 11. A stepped-up portion 23 is formed on the front side 22a of the terminal plate 22. A row of power terminals 24 are planted on the terminal plate 22 by integral molding at a predetermined pitch. A pair of the power terminals on opposite sides are used as ground terminals 25. A row of signal terminals 26 are planted on the terminal plate 22 by integral molding at a half of the pitch. Terminal sections 24a, 25a, and 26a and connection sections 24b, 25b, and 26b of the power terminals 24, ground terminals 25, and signal terminals 26 project forwardly from the front side 22a and rearwardly from the back side 22b of the insulation plate 22, respectively. The terminal unit 21 is incorporated into the housing 4.

Figure 14:
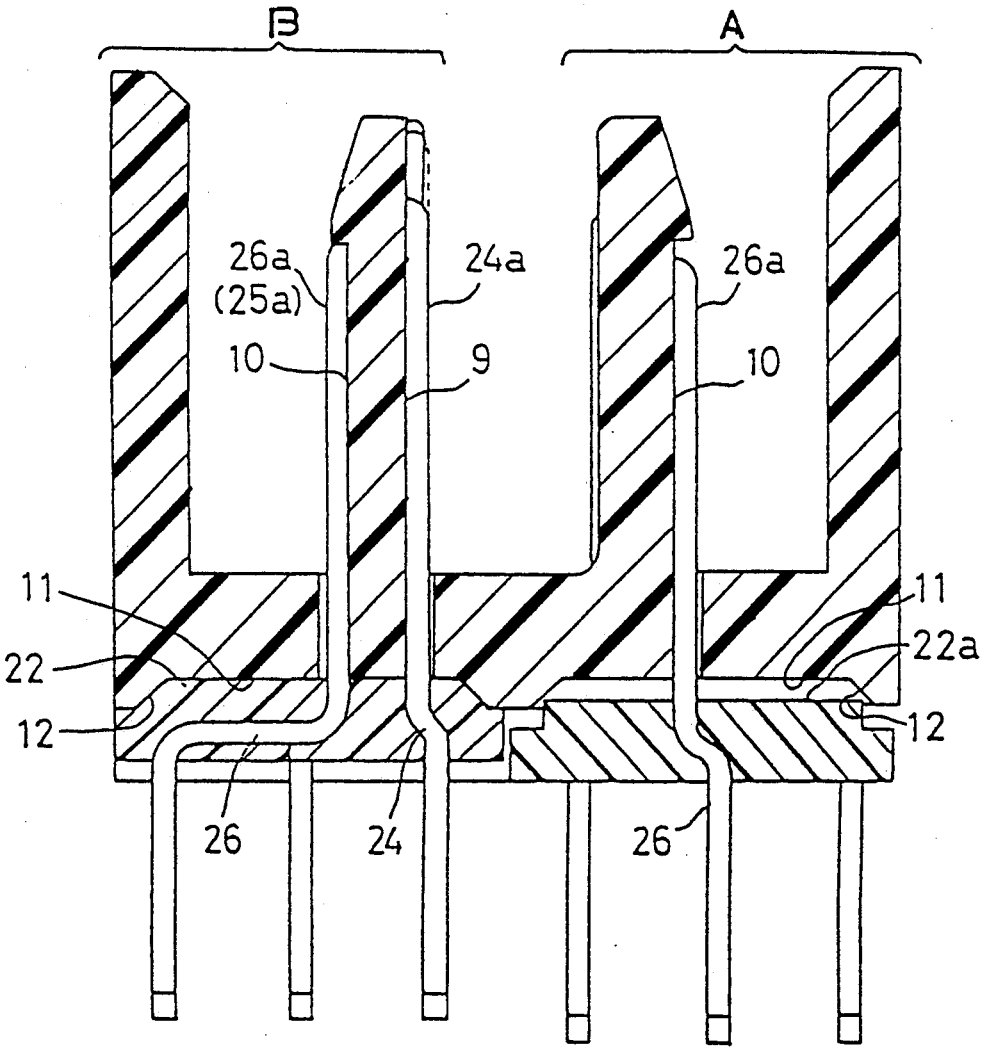
FIG. 14 is a sectional view of the male connector.

In FIG. 14, a terminal unit 21 is placed on each receiving recesses 11 such that the terminal sections 24a, 25a, and 26a of the power terminals 24, ground terminals 25, and signal terminals 26 are put through the terminal apertures 13 and 14 of the housing 4. This condition is illustrated on the right part A, wherein the terminal sections 24a, 25a, and 26a of the power terminals 24, ground terminals 25, and signal terminals 26 are fitted in the receiving channels 9 and 10, respectively, and the front side 22a of the insulation plate 22 is opposed to the receiving recess 11, and the ridges 15 and 16 abut on the front side 22a so that the terminal plate 22 is not fitted in the receiving recess 11.

Then, the terminal plate 22 is fused to the housing 4 by ultrasonic fusion. The periphery of the terminal plate 22 is fused to the sloped side wall 12 while the ridges 15 and 16 are fused to the terminal plate 22 so that the terminal plate 22 is fused to the receiving recess 11 completely. This condition is illustrated in the left part B.

Figure 30:
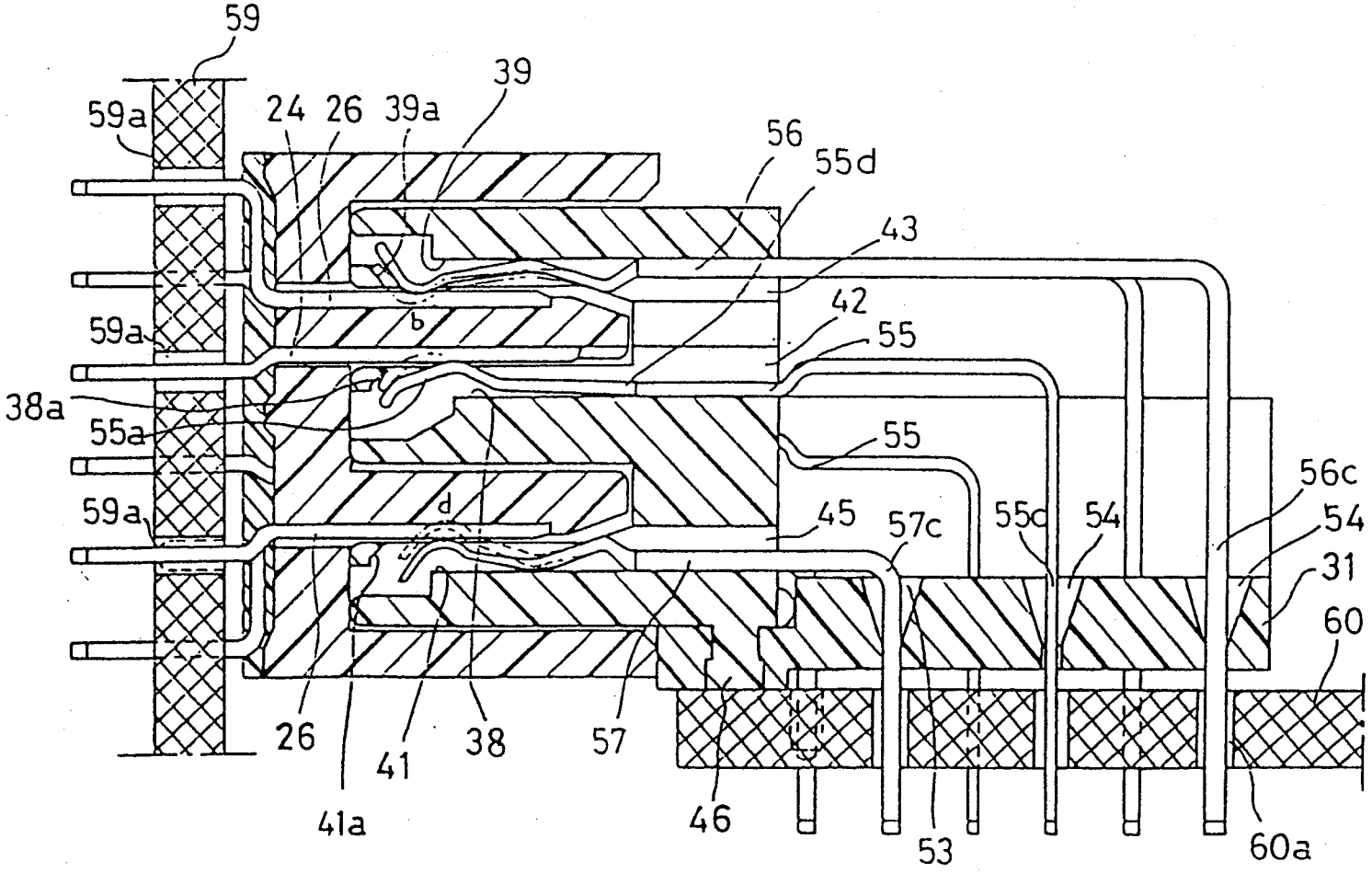
FIG. 30 is a sectional view of the male connector and the female connector under the connected condition.

As FIG. 30 shows, the male connector 2 is mounted on a circuit board 59 by soldering the legs 24a and 26a of the power terminals 24 and signal terminals 26 to the through holes 59a of the circuit board 59.

Figure 15:
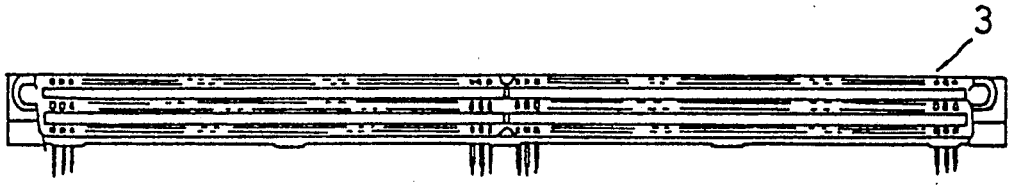
FIG. 15 is a front view of a female connector according to an embodiment of the invention.
Figure 16:
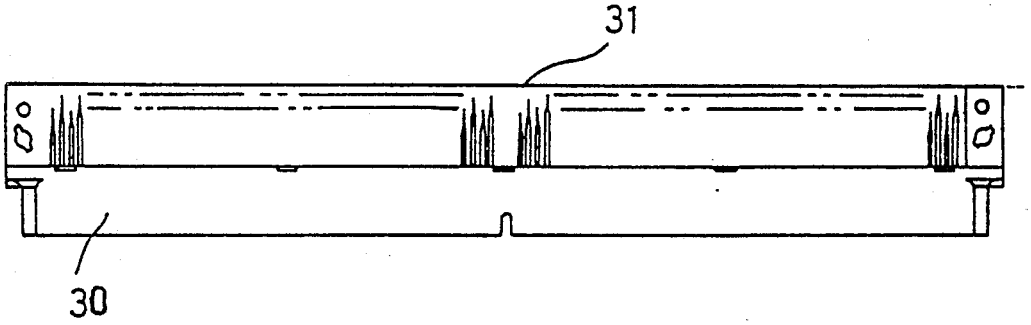
FIG. 16 is a top view of the female connector.
Figure 17:
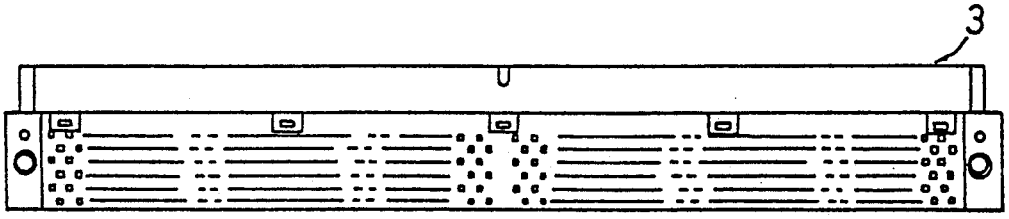
FIG. 17 is a bottom view of the female connector.
Figure 18:
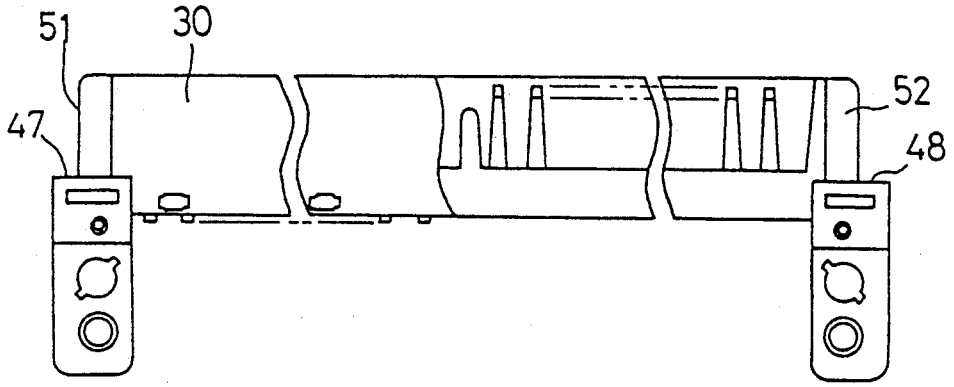
FIG. 18 is a bottom view of a housing of the female connector.
Figure 19:
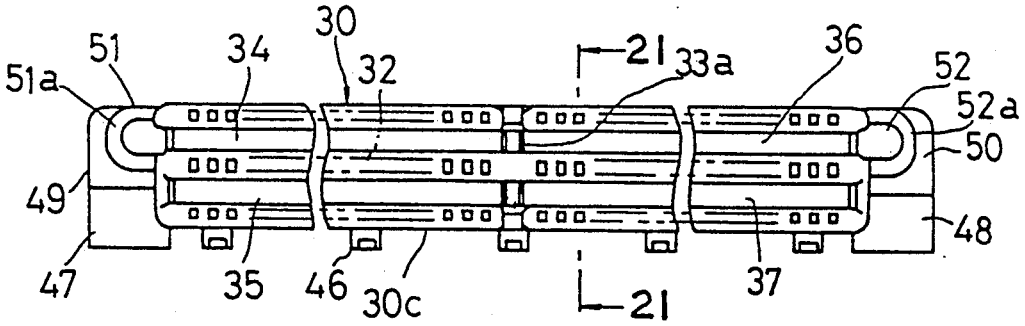
FIG. 19 is a front view of the housing.

In FIGS. 15–17, a female connector 3 of the right angle DIP type includes a substantially rectangular housing 30 and a detachable flat locator 31 which is attached to the rectangular housing 30 at right angles.

In FIGS. 18–21, the hollow housing 30 has a central insulation plate 32 extending forwardly from the rear wall 33. A cross rib 33a links the central insulation plate 32 to the housing 30 forming four fitting cavities 34, 35, 36, and 37. A number of power terminal receiving channels 38 are formed on one side of the insulation plate 32 at the predetermined pitch while a number of signal terminal receiving channels 39 are formed on the upper inside of the housing 30 at a half of the predetermined pitch. Similarly, a number of power terminal receiving channels 40 are formed on the other side of the insulation plate 32 at the predetermined pitch but offset by a half of the pitch with respect to the receiving channels 38. A number of signal terminal receiving channels 41 are formed on the lower inside of the housing at a half of the predetermined pitch. Terminal apertures 42, 44, and 45 are formed on the rear wall 33 of the housing 30 so as to communicate with the respective receiving channels 38, 39, and 41.

A number of engaging studs 46 extend downwardly from the bottom 30c of the housing 30. A pair of abutment mounts 47 and 48 are formed on opposite sides of the housing 30. A pair of guide recesses 49 and 50 are formed on the upper portions of the abutment mounts 47 and 48. A pair of guide projections 51 and 52 extend forwardly from the guide recesses 49 and 50 along opposite sides of the housing 30. The guide recesses 49 and 50 receive the guide portions 19 of the male connector 2 while the guide projections 51 and 52 are inserted into the foolproof recesses 17 and 18.

Figure 22:
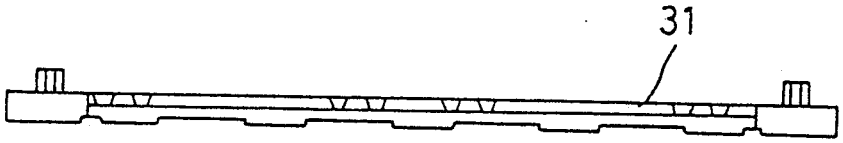
FIG. 22 is a side view of a flat locator of the female connector.
Figure 23:
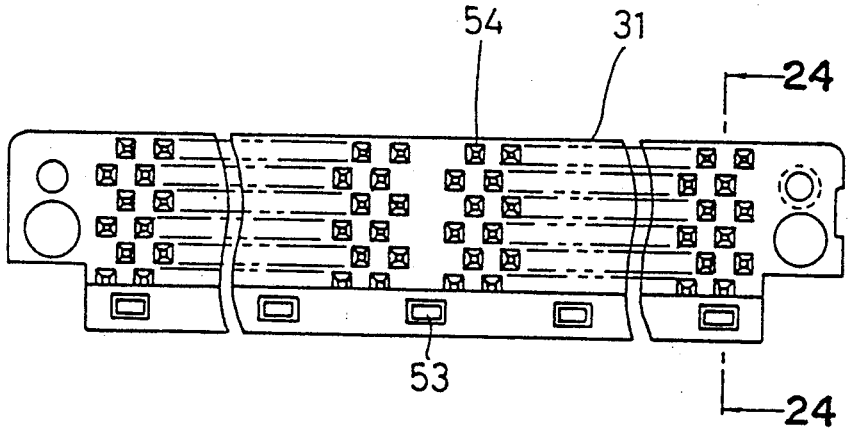
FIG. 23 is a top view of the flat locator.
Figure 24:
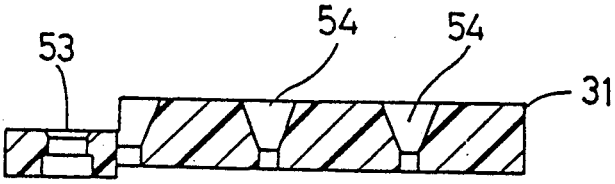
FIG. 24 is a sectional view taken along line 24—24 of FIG. 23.

In FIGS. 22–24, the flat locator 31 has a number of engagement holes 53 on the front stepped-down portion thereof and a number of terminal apertures 54 on the main portion thereof. The flat locator 31 is affixed to the bottom 30c of the housing 30 at right angles by fitting the engagement studs 46 of the housing 30 into the engagement holes 53 thereof (FIG. 30).

Figure 25:
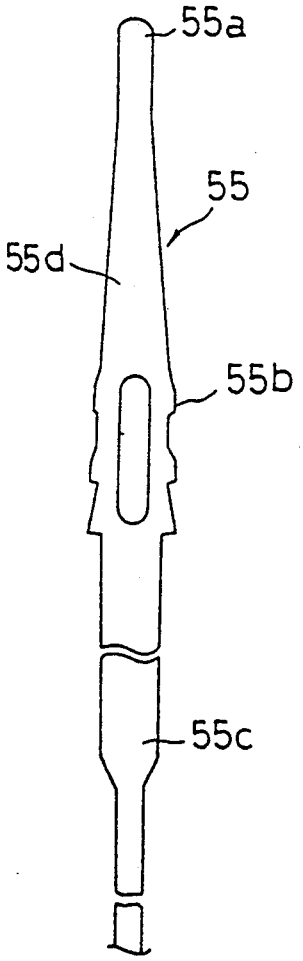
FIG. 25 is a top view of a power terminal according to an embodiment of the invention.
Figure 26:
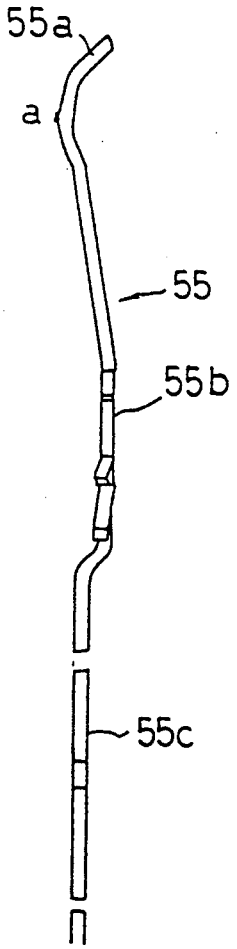
FIG. 26 is a side view of the power terminal.

In FIGS. 25 and 26, a power terminal 55 has a contact portion 55a, a press fit portion 55b, and a leg portion 55c. The section between the press fit portion 55b and the contact portion 55a is curved so as to provide a spring property. The contact portion 55a has a C-shaped cross section and a contact point a on the top.

Figure 27:
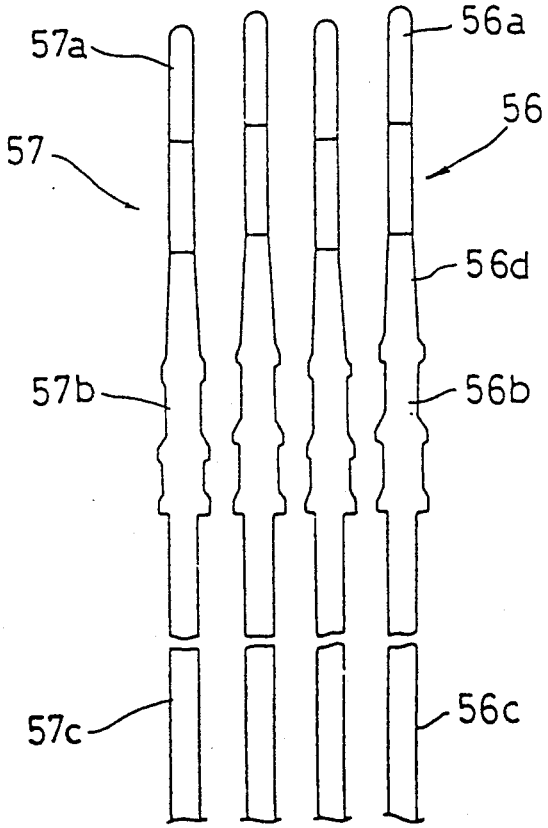
FIG. 27 is a top view of short and tall signal terminals according to an embodiment of the invention.
Figure 28:
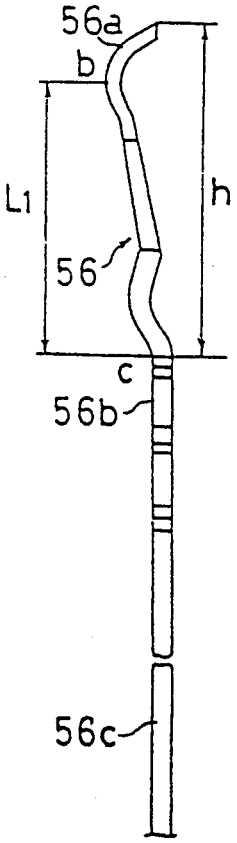
FIG. 28 is a side view of the tall signal terminal.
Figure 29:
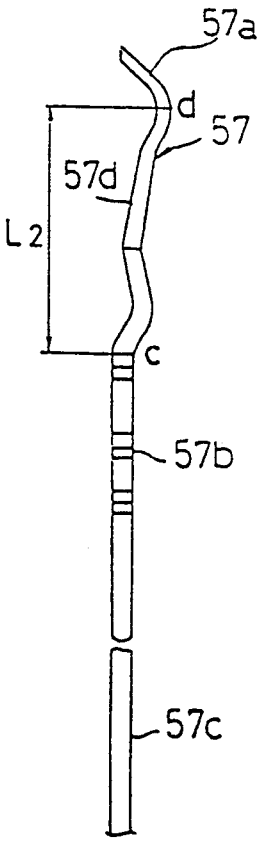
FIG. 29 is a side view of the short signal terminal.

In FIGS. 27–29, there are shown two types of signal terminals. A tall signal terminal 56 has a contact portion 56a, a press fit portion 56b, and a leg portion 56c. The contact portion 56a has a C-shaped cross section and a contact point b on the peak. The intermediate section 56d between the contact portion 56a and the press fit portion 56b increases its thickness toward the press fit portion 56b and has a C-shaped base portion to minimize both the height h of the contact portion 56a and the spring constant.

Similarly, a short signal terminal 57 has a contact portion 57a, a press fit portion 57b, and a leg portion 57c. The contact portion 57a has a C-shaped cross section and a contact point d on the top. The intermediate section 57d between the contact portion 57a and the press fit portion 57b increases its thickness toward the press fit portion 57b and a C-shaped base portion to minimize both the height h of the contact portion 57a and the spring constant. L2 is made smaller than L1 wherein L1 is the distance between the base point c of the intermediate section 56d and the contact point b and L2 is the distance between the base point c of the intermediate section 57d and the contact point d.

In FIG. 30, the power terminals 55 are put through the terminal apertures 42 of the housing 30 such that the intermediate sections 55d and the contact portions 55a are fitted in the receiving channels 38, with the end portions of the contact portions 55a engaging the hook portions 38a of the receiving channels 38. The leg portions 55c of the power terminal 55 are bent at right angles in middle portions, and the end portions are inserted in the engage holes 54 of the flat locator 31.

Similarly, the signal terminals 56 and 57 are put through the terminal apertures 43 and 45, respectively, such that the intermediate portions 56d and 57d and the contact portions 56a and 57a are fitted in the receiving channels 39 and 41, respectively, with the end portions of the contact portions 56a and 57a engaging the hook portions 39a and 41a of the receiving channels 39 and 41, respectively. The leg portions 56c and 57c of the signal terminals 56 and 57 are bent at right angles in the middle portions, and the end portions are inserted in the engagement apertures 54 of the flat locator 31. Since L1 and L2 are different, the contact points a and b are offset.

The female connector 3 is mounted on a board 60 by soldering the end portions of the leg portions 55*c*, 56*c*, and 57*c* of the power and signal terminals 55, 56, and 57 to the through holes 60*a*. The male and female connector 2 and 3 are connected so that the power terminals 24 and 55, and the signal terminals 26, 56, and 57 of the male and female connectors 2 and 3 are brought into contact with each other for providing electrical continuity between the two circuit boards 59 and 60.

When the male connector 2 is fitted in the female connector 3, the guide projections 51 and 52 are fitted in the foolproof recesses 20 while the guide portions 19 are fitted in the guide recess 50, with the sloped wall 52*a* abutting on the tapered walls 20*a*. Since the guide portions 19 are received by the guide recesses 50, the height of the connector is minimized.

The thickness of the straight portion 56*d* (57*d*) of the female signal terminal 56 (57) between the contact points 56*a* (57*a*) and the press-fit portion 56*b* (57*b*) is increased toward the press-fit portion 56*b* (56*b*) while the base portion of the straight section 56*d* (57*d*) is formed in a C-shape so that not only the height of the contact section. 56*a* (57*a*) but also the spring constant are minimized. In addition, since the contact points b and c of the contact portions 56 and 57 of adjacent signal terminals 56 and 57 are offset, the plugging force is minimized, thereby making it easy to plug in and out the super multipole connector.

I claim:

1. A super multipole electrical connector comprising:

a substantially rectangular housing having a plurality of terminal receiving channels and first terminal apertures each communicating with a corresponding terminal receiving channels;

a flat locator secured to said housing at substantially right angles and having a plurality of second terminal apertures each having an axis substantially perpendicular to that of said first terminal aperture;

a plurality of signal terminals having a contact section projecting along said terminal receiving channel, a press-fit section received in said first terminal aperture, and a leg section received in said second terminal aperture of said flat locator;

said contact section having a C-shaped portion with a contact point at a peak thereof;

an intermediate section between said contact section and said press-fit section being made different in length from those of adjacent ones so that said contact points of adjacent signal terminals are offset with each other, thereby minimizing plugging in and out forces.

* * * * *